United States Patent [19]

Scribner

[11] 4,160,518

[45] Jul. 10, 1979

[54] DOUBLE STROKE FEEDER

[76] Inventor: Albert W. Scribner, 6 Country Club Rd., Darien, Conn. 06820

[21] Appl. No.: 875,619

[22] Filed: Feb. 6, 1978

[51] Int. Cl.[2] ..... B65H 17/42

[52] U.S. Cl. ..... 226/115; 226/162

[58] Field of Search ..... 226/115, 112, 123, 162–166; 83/277

[56] References Cited

U.S. PATENT DOCUMENTS

| | | | |
|---|---|---|---|
| 3,583,268 | 6/1971 | Scribner | 226/112 |
| 3,847,320 | 11/1974 | Scribner | 226/115 |
| 4,051,987 | 10/1977 | Scribner | 226/115 |

*Primary Examiner*—Allen N. Knowles

[57] ABSTRACT

An improved control system for a dual slide type stock feeder for punch presses and the like, said control system being adapted to cause the feeder to execute two serial feed strokes in response to each cyclic operation of the punch press. The control system comprises a control plunger which is responsive to the movement of the press ram and which is adapted to actuate a fluid control circuit that causes one of said feed slides to execute a feed stroke and then causes the other feed slide to execute a feed stroke; there being two serial stock feed strokes produced for each cyclic operation of said control plunger. The feed slides may be controlled so as to operate in a substantially 180 degree mutual phase relation, or each may automatically complete an index stroke immediately after completing a feed stroke so that both of said feed slides are normally disposed in indexed positions.

30 Claims, 8 Drawing Figures

DOUBLE STROKE FEEDER

BACKGROUND OF THE INVENTION

In prior duplex type stock feeders, such as that illustrated in my prior U.S. Pat. No. 4,051,987, where the feeder is operated in response to and under the control of a punch press, each successive actuation of the control plunger or other input means of the feeder produces one feed stroke of the feeder. This mode of control is illustrated in the above cited patent wherein when control plunger 30 of said patent is operated a first time by the press ram one of the two feed slides 14, 15 partakes of a stock feed stroke while the other slide partakes of an index stroke, and in response to the next cyclic operation of said control plunger said one feed slide partakes of an index stroke while said other slide partakes of a feed stroke. This type of duplex feeder control, i.e. generating a single stock feed stroke in response to each cyclic operation of the press ram, is well suited for duplex feeders that are to accommodate higher speed stamping operations, but such may exhibit some of the drawbacks of single slide feeders when such duplex feeders are used for slower or normal speed stamping operations.

SUMMARY OF THE INVENTION

The control means for a duplex feeder as described herein includes a fluid control circuit and a control plunger; the latter being adapted to be moved between normal and depressed positions in response to the operation of the press ram. The control plunger or similar input control means is adapted to cause the fluid control circuit means to initiate a feed stroke of one of the two feed slides, and is further adapted to cause the other feed slide to initiate a feed stroke in response to the completion of the said feed stroke of said one feed slide. By providing such a control system in a dual slide feeder environment certain advantages are obtained; for example instead of using a single slide type feeder to obtain say a six inch feed stroke a double stroke dual slide unit may be used with each of the two feed slides partaking of a three inch stroke. Under these conditions the physical length of the feeder may be substantially shortened for a given feed operation, thus affording a corresponding decrease in size, weight and cost of the unit. Further, the sliding seals in the two main feed cylinders of the feeder will need changing much less often.

The primary object of the present invention is to provide a novel control system for a duplex stock feeder whereby the feeder executes two stock feed strokes in response to each cyclic operation of the press with which the feeder is to be used.

Another object of the invention is to provide a dual slide feeder control wherein a series of feed strokes may be generated for each cycle of operation of the press; and wherein the feed stroke of one feed slide is initiated in response to the completion of a feed stroke of the other feed slide.

A further object of the invention is to provide a novel control system for a dual slide feeder wherein a feed stroke by one of said slides is prevented from being initiated until after said one feed slide has completed its next preceding index stroke.

Other objects of the invention will become apparent as the disclosure progresses.

DETAILED DESCRIPTION OF THE INVENTION

Figure 1:
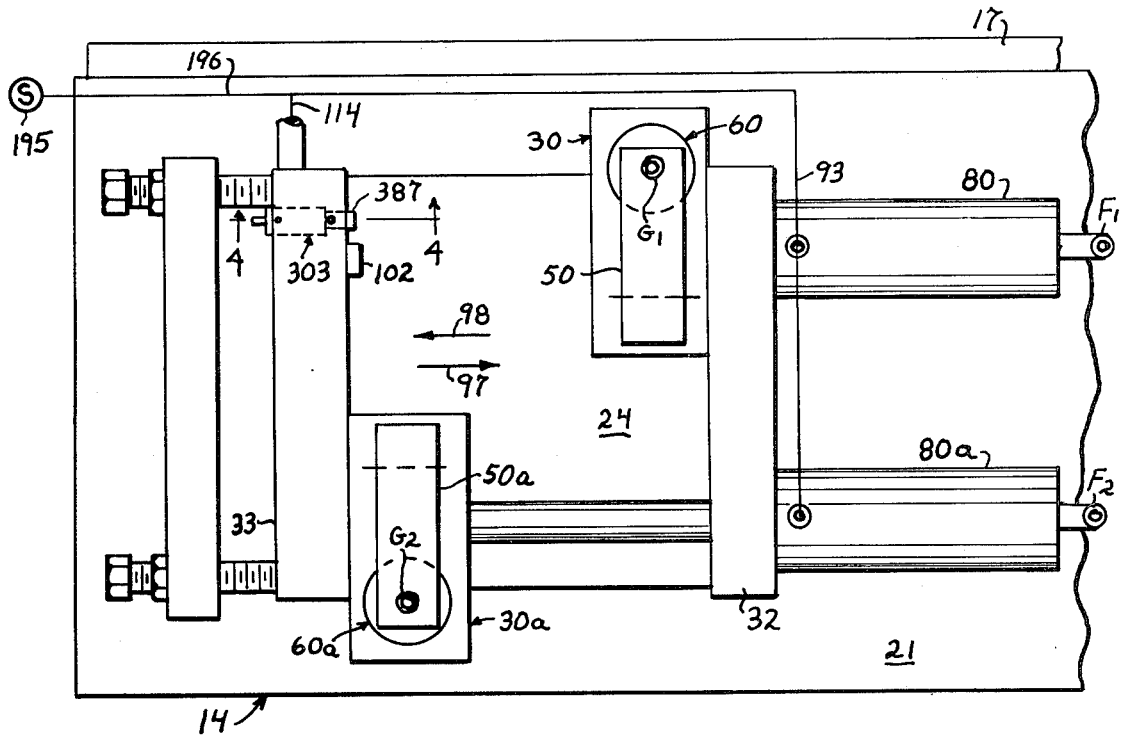
FIG. 1 is a plan view of an exemplary duplex feeder to which the present improved control system may be applied.
Figure 2:
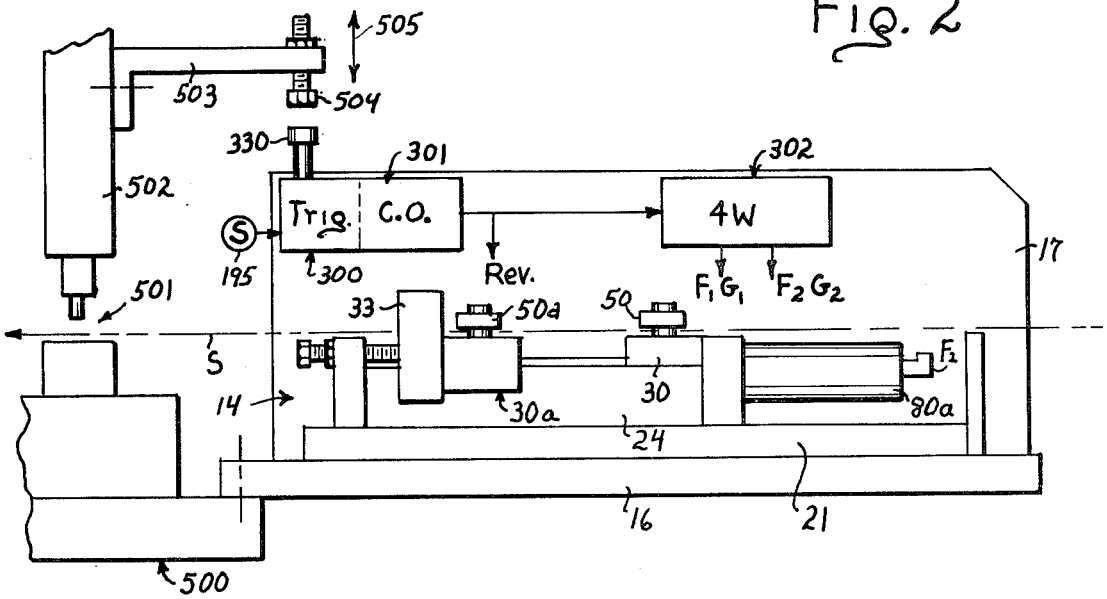
FIG. 2 is a front elevational view illustrating the apparatus shown in FIG. 1 and also some of the general features of the control system therefor.

The present novel control system may be used in combination with any one of a number of different versions of a duplex type feeder, and for illustrative purposes will herein be shown as controlling a dual slide feeder of the type shown and described in my prior U.S. Pat. No. 3,847,320. FIGS. 1 and 2 herein generally illustrate the construction and arrangement of the feeder transport section shown in said U.S. Pat. No. 3,847,320 and a general description of this transport section will be presented first. The stock transport or feeder section 14 includes a horizontal base plate 21 and a slide block 24 that carries a pair of feed slides 30, **30*a* that are adapted to reciprocate in feed and index directions 98 and 97 respectively, FIG. 1, between an abutment spacer plate 32 and an adjustable buffer abutment block 33. The feed slides 30, 30*a* are adapted to be reciprocally actuated by means of a pair of double acting fluid motors 80 and 80*a*, respectively, and carry stock gripping levers 50 and 50*a* that are adapted to be operatively actuated between stock gripping and release positions by means of single acting fluid motors 60 and 60*a* carried by said feed slides respectively. The rod ends of the double acting main feed motors 80 and 80*a* and the buffer abutment block 33 are adapted to be continuously supplied through lines 93 and 114 respectively from the fluid pressure source 195 through line 196. Fluid pressure is adapted to be supplied to and exhausted from the head ends of said main fluid motors 80 and 80*a* and the single acting gripper motors 60 and 60*a* through suitable fittings F1, F2, G1 and G2 respectively. As will be apparent by appropriately controlling pressure fluid flow to and from the said four motors each feed slide 30 and 30*a* may be alternately moved through stock feed and index strokes in the feed and index directions 98 and 97, FIG. 1, respectively. If a more detailed description of the construction and operation of the duplex feeder illustrated in FIGS. 1 and 2** hereof is desired reference may be made to the said U.S. Pat. No. 3,847,320, the disclosure therein being incorporated herein by reference.

The control system for the transport feeder section 14 generally comprises a trigger valve 300, FIG. 2, a self cut off valve 301, FIG. 2, a main four way valve 302, FIG. 2, a pressure release or reverse valve 303, FIG. 1, and a control plunger 330, FIG. 2, that is adapted to control the operation of said trigger valve 300. The reverse valve 303 is operatively disposed in the buffer abutment block 33 while the remaining elements of said control means are supported by any suitable means such as a vertically disposed plate 17 that is secured to the horizontal mounting plate 16 carrying said base plate 21.

Figure 3:
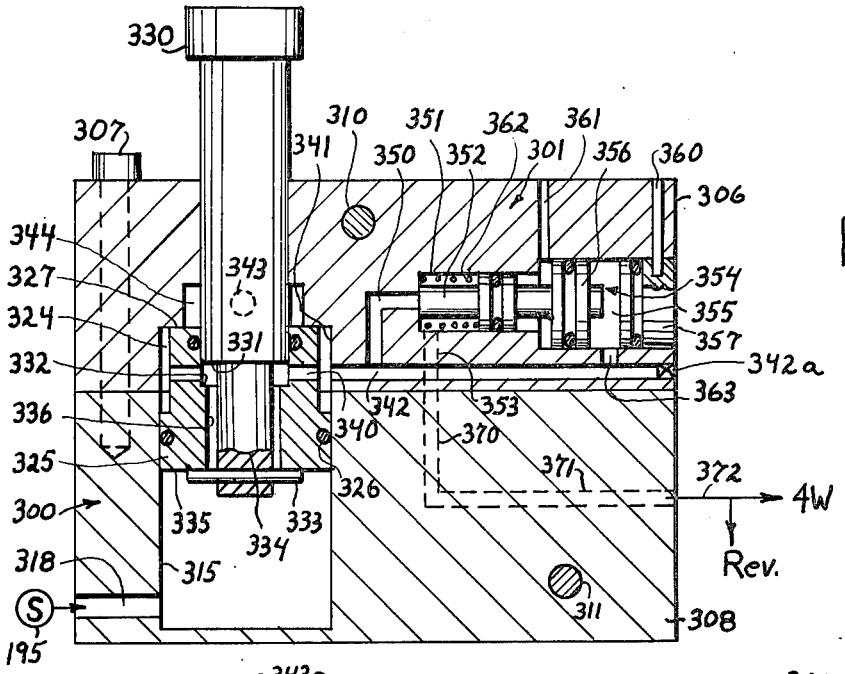
FIG. 3 is a vertical sectional view taken through the axes of the illustrated trigger and self cut off valves of the present control system.
Figure 5:
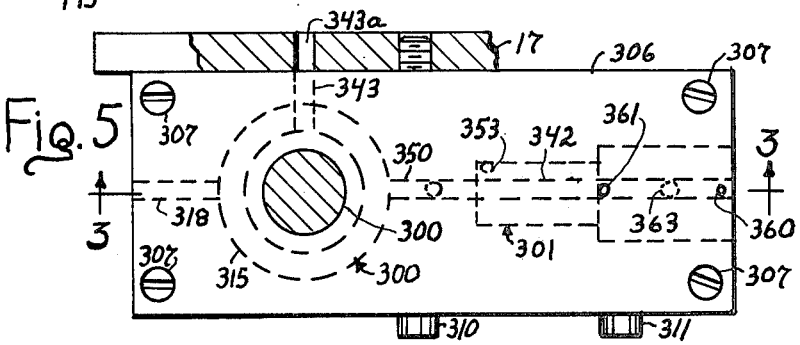
FIG. 5 is a plan view of the apparatus illustrated in FIG. 3.

The construction and operation of the various above noted components of the feeder control system will now be described individually and in detail. The trigger valve 300 and the self cut off valve 301 are illustrated in FIGS. 3 and 5. Here an upper valve block 306 is secured by means of screws 307, FIG. 3, to a lower valve block 308; both said upper and lower blocks being secured to said vertical plate 17 by any suitable means such as screws 310 and 311. The trigger valve 300 includes a cylindrical chamber or recess 315 that is formed in the lower block 308; the lower portion of the valve recess 315 being adapted to be continuously supplied with pressure fluid from said sorce 195 through an air line 318, FIGS. 3 and 5 formed in said block 308. A shouldered passage 324 formed vertically through the upper block 306 is coaxially disposed with respect to the said recess 315. Disposed in said passage 324 is a valve disc or poppet 325 which is provided with a peripheral O-ring 326 that is adapted to sealingly and slidably engage the vertical walls of said valve recess 315. The reduced upper end of poppet 325 is adapted to be yieldably biased into normal sealing engagement with the adjacent shoulder 327 of said recess 324 by reason of the pressure fluid in the lower portion of chamber 315 continuously acting upwardly on the poppet 325. The lower end of a valve stem or feeder control plunger 330 extends through a shouldered hole axially formed through the poppet 325; the shoulder 331, FIG. 3, on said stem or plunger being normally spaced from the internal shoulder 332 formed in the said axial hole through said poppet as shown in FIG. 3 but being adapted upon downward movement of stem 330 to sealingly engage the said shoulder 332. The upper limit of movement of stem 330 relative to the poppet 325 is determined by engagement of a diametral pin 333, FIG. 3, carried by the lower reduced end 334 of said stem 330 with the lower radial face 335 of said poppet 325. The cylindrical outer surfaces of the said reduced end 334 of the stem 330 are radially spaced from the adjacent inner walls 336 of the axial hole through said poppet 325. The stem 330 is normally maintained in its upper position relative to poppet 325 by the said continuous action of the pressure fluid in the lower portion of said valve chamber or recess 315. A plurality of radially extending holes 340 formed through the walls of the poppet 325 communicate the said axial hole in the poppet 325 with the annular space surrounding the upper reduced end of the poppet and adjacent the cylindrical wall 341 of the lower portion of the recess 324 in the valve block 306. Communicating through said wall 341 and with said annular space is a trigger valve output line 342 that is horizontally formed in the valve block 306; the outer end of said line 342 being closed by a plug **342*a***.

In the operation of the trigger valve 300 continuous pressure fluid in the lower portion of recess 315 will yieldably maintain said poppet 325 and stem 330 in their said normal or upper positions illustrated in FIG. 3 wherein pressure fluid can flow through the annular space between the reduced lower end 334 of the valve stem 330 and the adjacent internal walls 336 of the poppet 325, and through said radial lines 340 and the annular space adjacent said wall 341 to the said valve output line 342. When the stem 330 is depressed downwardly the stem will initially move axially relative to poppet 325 until the plunger shoulder 331 sealingly engages the internal poppet shoulder 332 so as to prevent further flow of pressure fluid from the lower portion of valve chamber 315 to the valve output line 342. Continued downward movement of the stem 330 will cause the poppet 325 to also move axially downward so that the upper reduced end of the poppet will move away from the shoulder 327 of the valve block 306 whereby pressure fluid in the output line 342 of the trigger valve 300 may now exhaust through an exhaust line or hole 343, FIGS. 3 and 5, which is formed through the wall of said valve block 306 and through the exhaust hole **343*a*, formed in said vertical plate 17; line 343 communicating with the reduced portion 344, FIG. 3, of the said recess or hole 324 formed through said valve block and being located above said shoulder 127 as is best seen in FIGS. 3 and 5. When the depressed valve stem is permitted to move upwardly in response to the upward movement of the press ram the pressure fluid in said lower portion of the valve recess 315 causes both the poppet 325 and the control plunger or stem 330 to move upwardly until the reduced upper end of the poppet engages the said shoulder 327 thereby blocking further fluid exhaust flow through said exhaust hole 343. Continued upward movement of the stem 330 to its normal upper FIG. 3 position causes the stem shoulder 331 to move upwardly out of sealing engagement with the poppet shoulder 332 so that pressure fluid from the lower portion of the valve chamber 315 may again flow into the valve output line 342** as above described.

The output line 342 of the trigger valve is connected to operate the cut off valve 301. Referring now primarily to FIG. 3 the valve block 306 is formed with a right angled passage 350 that communicates the said output line 342 of the trigger valve with the axial center of the left hand end, as seen in FIG. 3, of a cylindrical valve chamber 351 in which is disposed a valve member 352 that is adapted to be moved into and out of engagement with the said left hand end of the valve chamber 351 so as to respectively prevent and permit flow of pressure fluid from trigger valve output line 342 and line 350 into the chamber 351. Communicating with the said left end of said chamber 351 is a vertically disposed cut off valve output line 353, FIGS. 3 and 5, that is formed in the valve block 306. The valve member 352 is adapted to be moved from its right hand, as seen in FIG. 3, flow permitting position to its left hand fluid flow preventing or blocking position shown in FIG. 3 by means of a single acting fluid motor 354, FIG. 3, which comprises a cylinder 355 formed in said valve block 306 and in which is slidably disposed a piston 356 having an integral piston rod that axially extends to the left, as seen in FIG. 3, and is integrally and coaxially connected to the said valve cut off valve member 352. The head end, or right hand end as seen in FIG. 3 of the cylinder 355 is effectively closed by a suitable plug 357 that is secured in said valve block 306 by any suitable means such as a pin 360. Suitable O-ring seals are provided where needed as shown in FIG. 3; and a venting passage 361 is formed through the upper wall of said valve block 306 so as to be capable of venting the rod end of said fluid motor 354 so that said piston 356 may freely move when energized. The valve member 352 and hence the piston 356 of the fluid motor 354 are normally yieldably biased to the right as seen in FIG. 3 by means of a compression spring 362, FIG. 3, disposed in chamber 351 so as to place said valve member in its normal fluid flow permitting position. Pressure fluid is introduced into the right hand end of the cylinder 355 through a line 363, FIG. 3, that communicates between the cylinder 355 and the said trigger valve output line 342. When pressure fluid flows into cylinder 355 the piston 356 will move to the left as seen in FIG. 3 and will thus place said valve member 352 in its said fluid flow blocking position wherein no pressure fluid may flow from line 350 into the valve chamber 351 and to the said valve output line 353.

In the operation of the self cut off valve 301 when the valve member 352 is in its said normal right hand position and pressure fluid is directed into the line 342 by the trigger valve 300 such fluid will flow through line 350 and into the valve chamber 351 from where it will flow into the cut off valve output line 353. Simultaneously however the fluid pressure in said trigger valve output line 342 will flow through line 363 and into the cylinder 355 so as to energize said fluid motor 354 whereby said valve member 352 will be moved to its said left hand position wherein pressure fluid flow from the line 350 into chamber 351 and into output line 353 is cut off or blocked. When the output line 342 is exhausted by the above described operation of the trigger valve 300 the spring 362 will cause the valve member 352 and hence the piston 356 to move back to its said normal right hand or fluid flow permitting position. A suitable restriction illustrated at 364 of FIG. 6, may be provided in the said line 363 to the fluid motor 354 so that a desired short time delay may be obtained between the time that pressure fluid starts flowing from line 350 into chamber 351 and the time that such flow is thereafter cut off by the valve member 352 due to the said operation of the fluid motor 354. The output line 353 from the self cut off valve 301 communicates and is coextensive with a vertical line 370, FIG. 3, formed in the lower block 308. The line 370 communicates with a horizontal output line 371 which communicates through a suitable fitting with suitable external flexible tubing indicated generally at 372 of FIG. 3.

Figure 4:
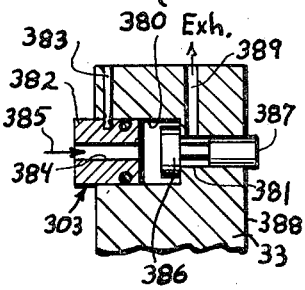
FIG. 4 is a vertical sectional view taken along section line 4—4 of FIG. 1.

The construction and operation of the pressure release or reverse valve 303 is illustrated in FIG. 4. The adjustable buffer abutment block 33 is formed with a horizontally disposed cylinder 380 and a smaller coaxial coextensive cylindrical opening 381. The left hand end, as seen in FIG. 4, of chamber 300 is effectively closed by means of a sealing plug 382 that is secured to block 33 by any suitable means such as a pin 382; the plug 383 being formed with an axial passage 384 therethrough and into which, through a suitable fitting, pressure fluid may enter chamber 380 as indicated by arrow 385 of FIG. 4. A disc type valve member 386 is adapted to sealingly seat on the annular inner end face of said cylindrical chamber 380; the valve member having an integral coaxial stem 387 extending to the right as seen in FIG. 4 and through said opening 381 so as to project slightly beyond the abutment face 388 of said block 33. The inner end of the valve stem 387 is reduced in diameter so as to permit exhaust of pressure fluid from chamber 380 to an exhaust line 389 when the valve member 386 and stem 387 are displaced to the left as seen in FIG. 4. The construction and operation of the four way valve 302 is illustrated in FIG. 2. This valve is mounted on the plate 17 in any suitable manner and may comprise any suitable commercially available unit that is yieldably biased, as is schematically indicated at 302B of FIG. 6, to one operative condition and is pilot operated by fluid pressure to its other operative condition. For smaller feeder models this valve could for example be constituted by a Model #MJV-4 four way valve that is presently commercially available from the Clippard Mfg. Co. of Cincinnati, Ohio.

Figure 6:
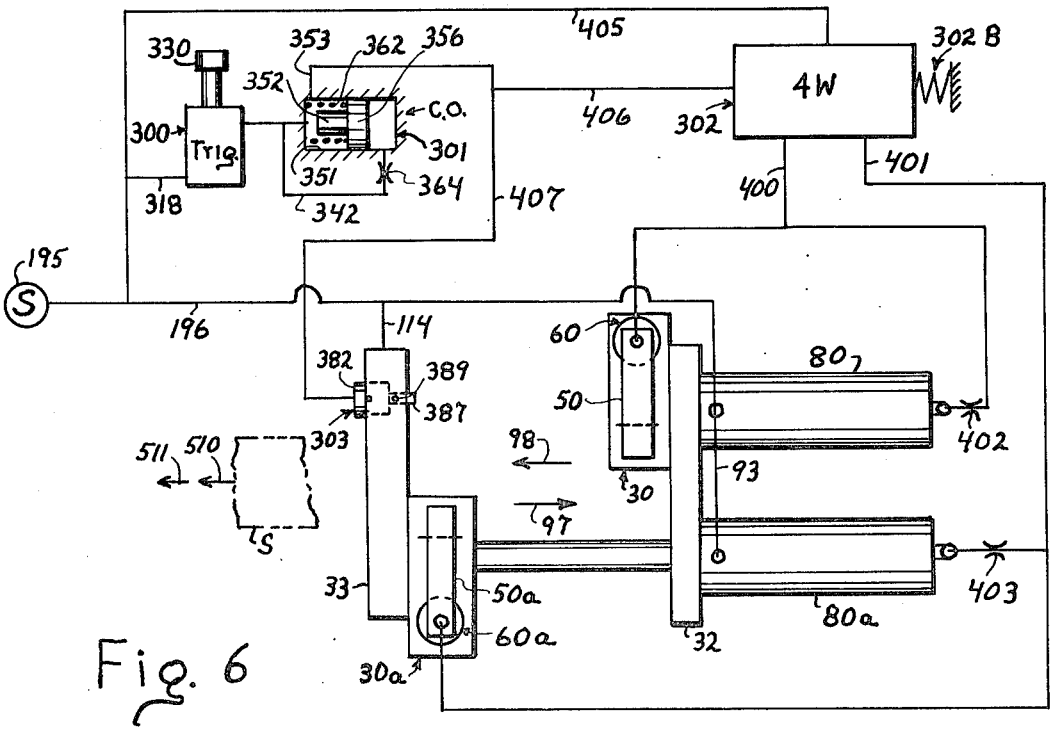
FIG. 6 is a circuit diagram illustrating the present double stroke type of control for a duplex feeder.

The trigger valve 300, self cut off valve 301, four way valve 302 and reverse valve 303 are interconnected in accordance with the circuit diagram of FIG. 6 so as control the operation of the said main feed fluid motors 80 and **80*a* and the gripper fluid motors 60 and 60*a*. One output line 400 of the four way valve 302 is connected so as to control the gripper motor 60 and the feed motor 80 associated with feed slide 30, while the other valve output line 401 is connected so as to control the gripper motor 60*a* and the feed motor 80*a* associated with the feed slide 30*a*. Suitable restrictions or chokes 402 and 403 may be used in the respective lines to feed motors 80 and 80*a* so that a slight desired time delay occurs between the time that the respective stock gripper motors 60 and 60*a* operate and the time that the feed motors 80 and 80*a* initiate stock feed or index strokes or slides 30 and 30*a* respectively. The four way valve 302 is supplied with pressure fluid through line 405 from said pressure fluid source 195. The output line 353 of the self cut off valve 301 is connected to the line 406 which controls the pilot operation of the four way valve 302 and also to the line 407 that is operatively connected to said reverse valve 303. The output line 342 from the trigger valve 300 is connected so as to control said self cut off valve 301 as above described, said trigger valve being supplied through line 318 with pressure fluid from source 195. As previously described pressure fluid is continuously supplied from source 195 and through lines 196 to the rod ends of the feed motors 80 and 80*a* and the buffer block 33 through line 93 and 114. If desired fluid pressure regulators may be provided in the lines 114 and 93**.

The present duplex feeder control system is adapted to be controlled by the operation of the punch press 500, FIG. 2; said press having a work station 501 into which the stock S is intermittently advanced so as to be stamped or otherwise worked by the reciprocating press ram 502. Secured to the press ram is a laterally extending bracket 503 to which is vertically adjustably secured a striker bolt 504 that is adapted to operate the said feeder control plunger 330 in response to the reciprocation of the press ram indicated at 505 of FIG. 2.

The details of the double feed stroke type operation for the present control means will now be described with primary reference to the circuit diagram of FIG. 6. In the normal condition of the circuit the line 406 will have been exhausted through reverse valve 303 so that the four way valve 302 may move to and remain in its normal condition wherein pressure fluid is exhausted from line 400 and supplied to line 401. Exhausting line 400 will cause the gripper motor 60 and the head end of the feed motor 80 to be exhausted whereby feed slide 30 will be displaced through an index stroke in direction 97 by the action of the continuously biased rod end of motor 80 so as to move to and remain in its normal indexed position shown in FIG. 6. At the same time supplying pressure fluid to line 401 will cause the gripper motor **60*a* and the head end of the feed motor 80*a* to be energized whereby the feed slide 30*a* will be displaced through a feed stroke in direction 98 against the action of the continuously biased rod end of motor 80*a*** so as to move to and remain in its normal forward or advanced position shown in FIG. 6. When the press ram 502 moves downwardly the striker bolt 504, FIG. 2, will engage and depress the feeder control plunger 330 whereupon the trigger valve output line 342 will be exhausted as above described and thus spring 362 of the self cut off valve 301 will move the valve member 351 to the right, as seen in FIG. 6, to its fluid flow permitting position illustrated in FIG. 6; the self cut off valve output line 353 as well as the downstream lines 406 and 407 having already been exhausted by the reverse valve 303 in a manner as will be described below. When the press ram completes its downward work stamping stroke and then moves upwardly the continuously upwardly biased control plunger 330 will move from its depressed position back to its normal FIG. 3 position wherein pressure fluid now flows into the trigger valve output line 342 and through the now open self cut off valve chamber 351 and into the output line 353 and lines 406 and 407 whereby the chamber of the reverse valve 303 will be pressurized and the four way valve 302 will be shifted to its other operative condition wherein pressure fluid is now supplied to said output line 400 and exhausted from said output line 401. Shortly after initiation of fluid flow through the self cut off valve 301 the cut off valve member 352 will be displaced to the left as seen in FIG. 6 by piston 356 so as to assume and remain in its flow blocking position illustrated in FIG. 3. Exhausting the four way valve output line 401 will now cause the gripper motor 60*a* and the head end of the feed motor 80*a* to be exhausted whereby feed slide 30*a* will be displaced through an index stroke in direction 97 by the action of the continuously biased rod end of motor 80*a* so as to move to an indexed position corresponding to that shown in FIG. 6 for feed slide 30. The simultaneous supply of pressure fluid to the valve output line 400 will cause the gripper motor 60 and the head end of the feed motor 80 to be energized whereby the feed slide 30 will be displaced through a feed stroke in direction 98 so as to move to an advanced position corresponding to that shown in FIG. 6 for slide 30*a*. This feed stroke of feed slide 30 will thus advance the stock S through a first incremental length of feed toward the work station 501 as indicated by arrow 510 of FIG. 6. During the terminal portion of the said feed stroke of feed slide 30, the latter will engage and displace the valve stem 387 of the reverse valve 303 to the left as seen in FIG. 6, this action serving to exhaust line 407 and thus lines 353 and 406 as above described. Under these conditions the four way valve 302 can now return to its said normal condition under its said biasing action as indicated at 302B. It will be noted that the exhausting here of the valve output line 353 does not affect the operation of the self cut off valve 301 which as will be recalled is now in its fluid flow blocking condition. The shifting of the four way valve 302 back to its normal condition will again cause pressure fluid to be exhausted from the valve output line 400 and pressure fluid to be supplied to the output line 401. Under these conditions the feed slide 30 will execute an index stroke while the feed slide 30*a* executes a feed stroke in the manner above described and thus the feed slide 30*a* will advance the stock S through a second incremental length of feed towards said work station 501 as indicated by arrow 511 of FIG. 6. As will be seen then for each cyclic of operation of the press ram 502 and of the accompanying downward and upward cycle of movement of control plunger 330, each of the feed slides 30 and 30*a* will partake of a feed stroke; these two feed strokes occurring one after the other whereby the feeding of the total desired length of stock S to be advanced into the working station 501 for each press cycle will be accomplished in two serial steps 510 and 511.

The above described control for a duplex type feeder will enable the feeder to be made much shorter in overall length for a given feed stroke requirement which in turn produces many economies in production and use. Also when using two main feed motors such as 80 and 80*a* for two substantially equal short feed strokes instead of using a single main feed motor for a single feed stroke of twice the stroke length, the sliding seals in said two feed motors will not need replacement for much longer effective operational time intervals than when using a single feed motor and a single associated feed slide as is illustrated for example in U.S. Pat. No. 3,038,645. Also the advantages offered by duplex type feeders as respects increased effective stock feed time available during each press cycle may be applied not only for high speed operations as described in said U.S. Pat. Nos. 4,051,987 and 3,847,320, but also to slower or normal speed stamping operations.

Figure 8:
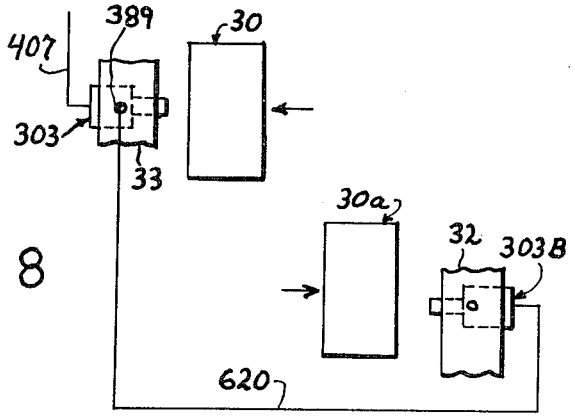
FIG. 8 is a fragmentary view showing the pertinent portions of a modified version of the control circuit shown in FIG. 6.

If it is desired to insure that each index stroke of feed slide 30*a* is completed before the initiation of the next feed stroke thereof an "and gate" type interlock or safety feature may be added to the circuit of FIG. 6. Referring to FIG. 8 a second reverse valve 303B similar to said valve 303 is operatively mounted in the block 32 in a position so as to be operated by the terminal portion of the index stroke of feed slide 30*a*. The control line 620 to said reverse valve 303B is connected through a suitable fitting to the exhaust line 389 of said valve 303 whereby both of said valves 303 and 303B, as arranged in FIG. 8, must be operated before the four way valve 302 will be shifted back to its said normal position so as to initiate a feed stroke of feed slide 30*a*. Thus a feed stroke of feed slide 30*a* will not be started prematurely i.e. before slide 30*a* has completed its index stroke and before feed slide 30 has completed its feed stroke.

Figure 7:
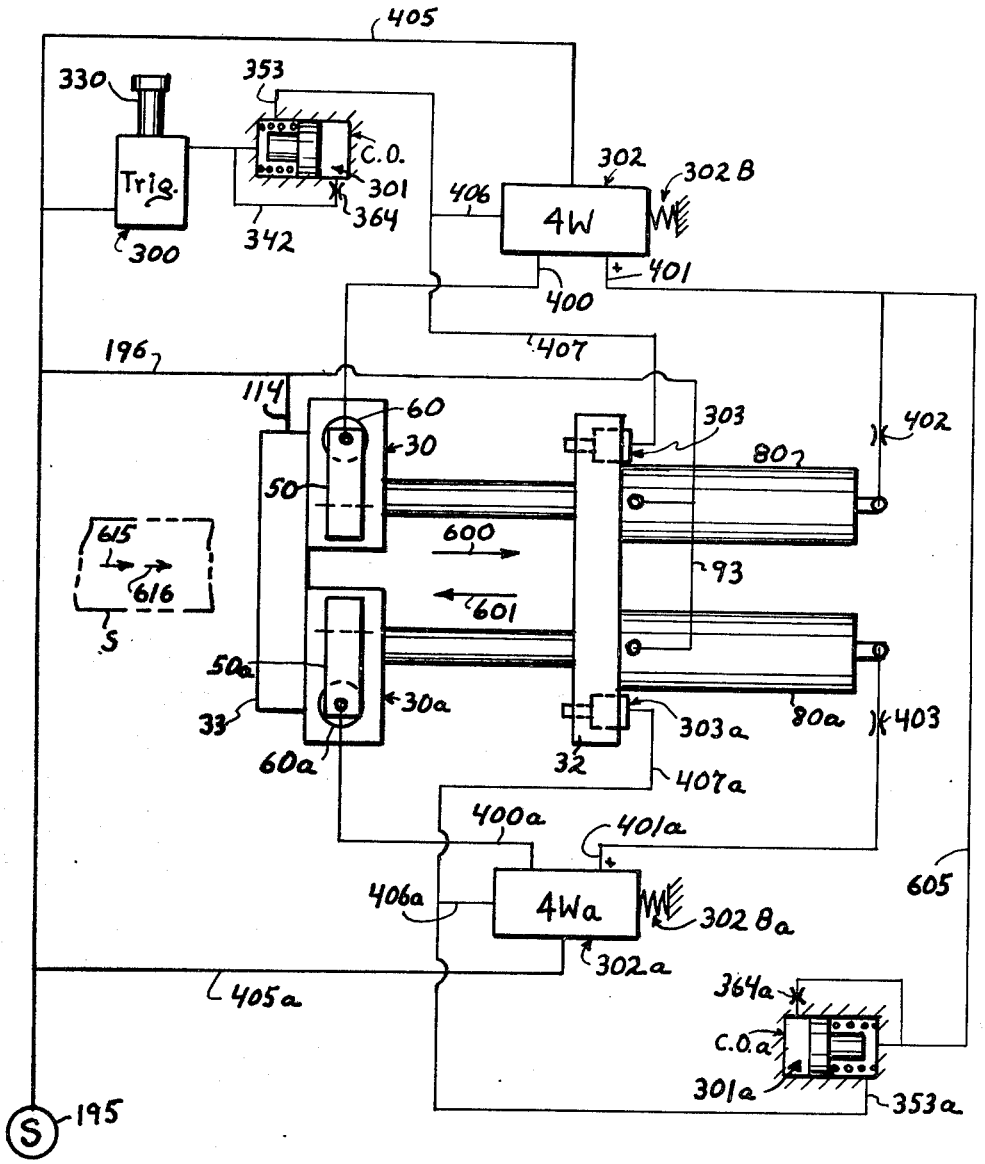
FIG. 7 is a circuit diagram for a modified version of the control system illustrated in FIG. 6.

In FIG. 7 there is shown a modified version of the circuit diagram of FIG. 6. It is to be noted at the outset here that the direction 600 for the feed of the stock S is opposite, i.e. to the right as seen in FIG. 7, to that for the control circuit described in connection with FIG. 6. In the FIG. 6 version of the control system the feed slides 30 and 30*a* are operated in substantially 180 degree mutual phase relation, i.e. while feed slide 30 is executing a feed stroke the feed slide 30*a* is executing an index stroke, and vice versa. In the FIG. 7 version of the control system the feed slide 30 will execute a feed stroke in direction 600 and will then immediately and automatically execute an index stroke in direction 601 so as to return to a normal indexed position in a manner similar to that described for feed slide 30 in connection with FIG. 6. However, when the feed slide 30*a* completes its feed stroke it will also immediately and automatically execute an index stroke rather than remaining in its forward or advanced position as in the case of the FIG. 6 version of the control system. Thus in the FIG. 7 arrangement both feed slides 30 and 30*a* will be normally disposed in their indexed positions as is shown in FIG. 7. To produce this automatic return to a normal indexed position by the feed slide 30*a* as well as for feed slide 30, a second similar reverse valve 303*a*, along with a first such valve 303 is provided in the said plate or block 32 whereby said valves 303 and 303*a* are adapted to be operated in response to the completion of the feed strokes of said feed slides 30 and 30*a* respectively.

Separate similar four way valves 302 and 302*a* are provided to control the feed and index strokes of feed slides 30 and 30*a* respectively, said valves 302 and 302*a* being adapted to be controlled in part by the reverse valves 303 and 303*a* respectively in a manner similar to that described in connection with FIG. 6. The four way valve 302 of FIG. 7 is controlled by the trigger valve 300 and self cut off valve 301 in a manner similar to that described above in connection with FIG. 6 while the four way valve 302*a* is similarly controlled by a second similar self cut off valve 301*a* which is in turn controlled through a line 605 connected to the output line 401 of the four way valve 302. Items in FIG. 7 are similar to the items correspondingly numbered in FIG. 6.

The operation of the FIG. 7 control plunger 330, trigger valve 300 and self cut off valve 301 causes the four way valve 302 to shift from its normal operative condition to its other operative condition as previously described wherein pressure fluid is supplied to valve output line 400 and exhausted from valve output line 401 thereby initiating a feed stroke of the feed slide 30 in direction 600. When the reverse valve 303 is operated at the end of this feed stroke of feed slide 30 the four way valve 302 will be returned to its normal condition as above described so that feed slide 30 will immediately return in direction 601 to its normal FIG. 7 indexed position, all in a manner similar to that described above in connection with FIG. 6. When the valve 302 is so returned to its said normal condition pressure fluid will flow into the valve output line 401 for producing the index stroke of feed slide 30 and will also flow through line 605 and momentarily through the said second self cut off valve 301*a* so as to shift the second four way valve 302*a* from its normal operative condition to its other operative condition whereby pressure fluid will be supplied to output line 400*a* and exhausted from valve output line 401*a* whereby feed slide 30*a* will execute a feed stroke in direction 600 in a manner similar to that just described for feed slide 30. Completion of this feed stroke by feed slide 30*a* will cause the second reverse valve 303*a* to operate which will cause said valve 302*a* to be restored to its said normal condition wherein said first slide 30*a* will immediately execute an index stroke in direction 601 so as to return to and remain in its normal FIG. 7 indexed position in a manner similar to that just described for feed slide 30. Thus in the FIG. 7 version of the present duplex feeder control system both feed slides are normally located in their indexed positions and when a feed cycle of operation is initiated by actuation of the control plunger 330 each of the feed slides 30 and 30*a* will execute both a feed stroke and an immediate automatic index stroke. Here then, as in the FIG. 6 version of the present control system, there will be two serial incremental stock feed steps 615 and 616, FIG. 7, produced in response to each cycle of operation of the punch press.

If desired an "an gate" type safety or interlock feature similar to that described in connection with FIG. 8 may be provided in the circuit of FIG. 7 so as to insure that a feed stroke of feed slide 30 is not started before the next prior indexing stroke thereof has been completed. The advantage of the FIG. 7 control version is that for each feed cycle the feed slide 30*a* is normally in an indexed position ready to initiate a feed stroke without having to be first moved through an index stroke as in the FIG. 6 control version. This will permit faster feed operations.

I claim:

1. A duplex type feeder for intermittently advancing stock into the work station of a press having a reciprocating ram; said feeder being adapted to be controlled so as to execute two successive incremental stock feeding strokes in response to each cyclic operation of said press: comprising a frame;

a pair of feed slides mounted on said frame for reciprocation in feed and index directions;

stock gripping means carried by each of said feed slides and being movable between stock gripping and stock release positions;

motor means for actuating said pair of feed slides and said stock gripping means so that each of said feed slides may be moved through feed and index strokes;

a first control means adapted to be operated in response to each cyclic operation of said press;

a second control means operative in response to the actuation of said first control means for causing one of said feed slides to execute a feed stroke; and a third control means operative for causing the other of said feed slides to execute a feed stroke after said one feed slide completes its said feed stroke, whereby each cyclic operation of said first control means causes said two feed slides to serially execute two stock feed strokes.

2. Apparatus as defined by claim 1 wherein said first control means is adapted to be displaced from a first position to a depressed position and then back to its said first position in response to the downward and upward movement respectively of said press ram, and wherein said second control means causes the initiation of the feed stroke of said one feed slide in response to the movement of said first control means from its said depressed position back to its said first position.

3. Apparatus as defined by claim 1 wherein said motor means comprises a plurality of fluid motors, and wherein said first control means includes a plunger that is adapted to be displaced in response to the movement of said press ram.

4. Apparatus as defined by claim 1 wherein said third control means is adapted to be operated in response to the terminal portion of the feed stroke of said one slide.

5. Apparatus as defined by claim 1 wherein said second control means includes a main valve means, and a self cut off valve means that is adapted to control the operation of said main valve and to be controlled by the operation of said first control means.

6. Apparatus as defined by claim 1 wherein said third control means includes reverse valve, and wherein said first control means includes a control plunger means.

7. Apparatus as defined by claim 1 wherein said motor means includes a pair of motors that are adapted to actuate said feed slides in substantially 180 degree phase relation so that when said one feed slide is being displaced through a feed stroke said other feed slide is being displaced through an index stroke, and vice versa.

8. Apparatus as defined by claim 1 wherein said second control means includes a main four way valve.

9. Apparatus as defined by claim 1: additionally comprising a fourth means including means adapted to be operative in response to the terminal portion of an index stroke of one of said feed slides for at least partially controlling the initiation of a feed stroke of said other feed slide.

10. Apparatus as defined by claim 9 wherein said fourth control means includes a means that is adapted to be operative in response to the terminal portion of an index stroke of said other feed slide.

11. Apparatus as defined by claim 1 wherein said third control means includes means for causing said other feed slide to initiate a feed stroke only upon completion of both a feed stroke of one of said feed slides and an index stroke of the other of said feed slides.

12. Apparatus as defined by claim 1: additionally comprising a fourth control means operative after completion of a feed stroke of said other feed slide for causing said other feed slide to be displaced through an index stroke to an indexed position where it will remain until the next two sequential feed strokes of said two feed slides are initiated in response to the next operation of said first control means.

13. Apparatus as defined by claim 12 wherein said fourth control means is adapted to be operated in response to the terminal portion of a feed stroke of said other feed slide.

14. A duplex stock feeder for intermittently advancing stock into the work station of a punch press or the like having a reciprocating ram; said feeder being adapted to be controlled so as to execute two successive stock feeding strokes in response to each cyclic operation of said punch press: comprising a frame;

a pair of feed slides mounted on said frame for reciprocation in feed and index directions;

stock gripping means carried by each of said feed slides and being movable between stock gripping and stock release positions;

a first fluid motor means for actuating said pair of feed slides;

a second fluid motor means for actuating said stock gripping means;

control valve means for controlling the operation of said fluid motors so that each of said feed slides may be alternately moved through feed and index strokes;

a control plunger means adapted to be moved from a first position to a depressed position and then back to its said first position in response to the downward and upward movement respectively of said punch press ram, the movement of said control plunger means from its said depressed position back to its said first position serving to operate said valve means so that one of said feed slides is moved through a feed stroke;

said control valve means including a reverse valve means operative after the said feed stroke of said one feed slide to further control the operation of said valve means so that the other feed slide is moved through a feed stroke, whereby each cyclic movement of said control plunger means from its said depressed position back to its said first position serves to initiate a pair of serial feed strokes by said feed slides; said duplex feeder thereby being adapted to generate two stock feeding strokes in response to each cyclic operation of said control plunger means.

15. Apparatus as defined by claim 14 wherein said first fluid motor means includes a pair of double acting fluid motors that are adapted to be operated under the control of said valve means in substantially 180 degree phase relation whereby when said one feed slide is being displaced through a feed stroke the said other feed slide is being displaced through an index stroke, and vice versa.

16. Apparatus as defined by claim 14 wherein said second fluid motor means comprises a pair of single acting fluid motors carried by said two feed slides respectively; and wherein said control valve means includes a main four way valve for controlling the operation of said first fluid motor means.

17. Apparatus as defined by claim 14 wherein said control valve means includes a trigger valve, a main valve, and a self cut off valve means that is adapted to be controlled by said trigger valve and to control said main valve.

18. Apparatus as defined by claim 14 wherein said reverse valve means is adapted to be operated in response to the terminal portion of a feed stroke of said one feed slide.

19. Apparatus as defined by claim 17 wherein said trigger valve comprises a normally conducting three way valve, and wherein said reverse valve means is adapted to be operated in response to the terminal portion of a feed stroke of said one feed slide.

20. Apparatus as defined by claim 14 wherein said reverse valve means is adapted to be operated in response to the completion of an index stroke of one of said feed slides.

21. Apparatus as defined by claim 14 wherein said reverse valve means includes a valve means that is adapted to be operated in response to the terminal portion of an index stroke of said other feed slide.

22. Apparatus as defined by claim 14 wherein said reverse valve means is adapted to be operative only upon completion of both a feed stroke of one of said feed slides and an index stroke of the other of said feed slides.

23. Apparatus as defined by claim 14; additionally comprising a second reverse valve means that is operating after completion of a feed stroke of said other feed slide to cause said other feed slide to return to an indexed position where it will remain until the initiation of the next pair of serial feed strokes in response to the next operation of said control plunger means.

24. Apparatus as defined by claim 23 wherein said first fluid motor means includes two fluid motors and wherein said valve means includes two main four way valves, each main valve controlling one of said fluid motors and being arranged to be controlled at least in part by one of said two reverse valve means respectively.

25. A pneumatically operated feeder that is adapted to intermittently advance stock into the work station of a punch press or the like having a working ram: said feeder comprising a frame;

first and second feed slides reciprocally mounted on said frame for movement in feed and index directions;

stock gripping means carried by each of said feed slides and adapted to be moved between stock gripping and stock release positions;

a first fluid motor means for reciprocally actuating said feed slides;

a second fluid motor means for actuating said stock gripping means between said stock gripping and stock release positions; and control means for controlling the operation of said first and second fluid motor means so that said first and second feed slides may execute a series of feed strokes, said control means including means operable in response to the terminal portion of a feed stroke of one of said feed slides for causing initiation of a feed stroke of the other one of said feed slides.

26. A pneumatically operated feeder that is adapted to intermittently advance stock into the work station of a punch press or the like having a working ram: said feeder comprising a frame;

first and second feed slides reciprocally mounted on said frame for movement in feed and index directions;

stock gripping means carried by each of said feed slides and adapted to be moved between stock gripping and stock release positions;

a first fluid motor means for reciprocally actuating said feed slides;

a second fluid motor means for actuating said stock gripping means between said stock gripping and stock release positions; and control means for controlling the operation of said first and second fluid motor means so that said first and second feed slides may execute a series of feed strokes; said control means including;

main valve means for controlling the operation of said first and second fluid motor means;

trigger means for controlling said main valve means so as to cause one of said feed slides to execute a feed stroke; and reverse means for controlling said main valve means so as to cause the other of said feed slides to execute a feed stroke.

27. Apparatus as defined by claim 25 or 26 wherein the operation of said control means is adapted to be initiated in response to the movement of said press ram.

28. Apparatus as defined by claim 26 wherein said reverse means is adapted to be operated in response to the terminal portion of a feed stroke of said one of said feed slides.

29. A pneumatically operated feeder that is adapted to intermittently advance stock into the work station of a punch press or the like having a working ram: said feeder comprising a frame;

first and second feed slides reciprocally mounted on said frame for movement in feed and index directions;

stock gripping means carried by each of said feed slides and adapted to be moved between stock gripping and stock release positions;

a first fluid motor means for reciprocally actuating said feed slides;

a second fluid motor means for actuating said stock gripping means between said stock gripping and stock release positions; and control means for controlling the operation of said first and second fluid motor means so that said first and second feed slides may execute a plurality of feed strokes for each cycle of operation of said press, said control means including means for normally maintaining both of said feed slides in their respective indexed positions.

30. A pneumatically operated feeder that is adapted to intermittently advance stock into the work station of a punch press or the like having a working ram: said feeder comprising a frame;

first and second feed slides reciprocally mounted on said frame for movement in feed and index directions;

stock gripping means carried by each of said feed slides and adapted to be moved between stock gripping and stock release positions;

a first fluid motor means for reciprocally actuating said feed slides;

a second fluid motor means for actuating said stock gripping means between said stock gripping and stock release positions; and control means controlling the operation of said first and second fluid motor means so that said first and second feed slides may partake of a plurality of feed strokes for each cycle of operation of said press, said control means including means for preventing initiation of a feed stroke of one of said feed slides until after completion by said one of said feed slides of an index stroke thereof.

* * * * *